United States Patent [19]

Faltin

[11] Patent Number: 4,566,687

[45] Date of Patent: Jan. 28, 1986

[54] TRANSFERRING NEWSPAPERS OR THE LIKE FROM A MOVING BELT TO A SERIES OF CLAMPS

[75] Inventor: Hans G. Faltin, York, Pa.

[73] Assignee: Custom-Bilt Machinery, Inc., York, Pa.

[21] Appl. No.: 609,326

[22] Filed: May 11, 1984

[51] Int. Cl.[4] ..... B65H 29/66

[52] U.S. Cl. ..... 271/202; 271/204; 271/277; 271/151

[58] Field of Search ..... 271/277, 202, 204, 206, 271/270, 151

[56] References Cited

U.S. PATENT DOCUMENTS

| | | | |
|---|---|---|---|
| 3,955,667 | 5/1976 | Müller | 271/204 |
| 4,333,559 | 6/1982 | Reist . | |
| 4,424,965 | 1/1984 | Faltin | 271/204 X |
| 4,489,930 | 12/1984 | Meier | 271/204 X |

FOREIGN PATENT DOCUMENTS

| | | | |
|---|---|---|---|
| 2917250 | 10/1980 | Fed. Rep. of Germany | 271/202 |
| 574364 | 4/1976 | Switzerland | 271/204 |

*Primary Examiner*—Richard A. Schacher

*Attorney, Agent, or Firm*—Laurence R. Brown

[57] ABSTRACT

Shingled precisely spaced papers are carried off a first conveyance path on a moving belt at a first speed into a further conveyance path along which a set of spaced clamps which individually grasp each paper flow at a substantially constant lower transit speed. By gradually inserting a paper into an open clamp travelling alongside in a parallel path over a predetermined transfer zone length overlapping a plurality of successive clamps, the instantaneous nature of feeding a paper into a clamp is changed so that a higher paper feed speed can be tolerated. By inclining the shingled paper feed path downwardly over the transfer zone, the drag of the papers off the shingled array is reduced to prevent any tendency to misalign the papers from a seated position in the clamps.

6 Claims, 1 Drawing Figure

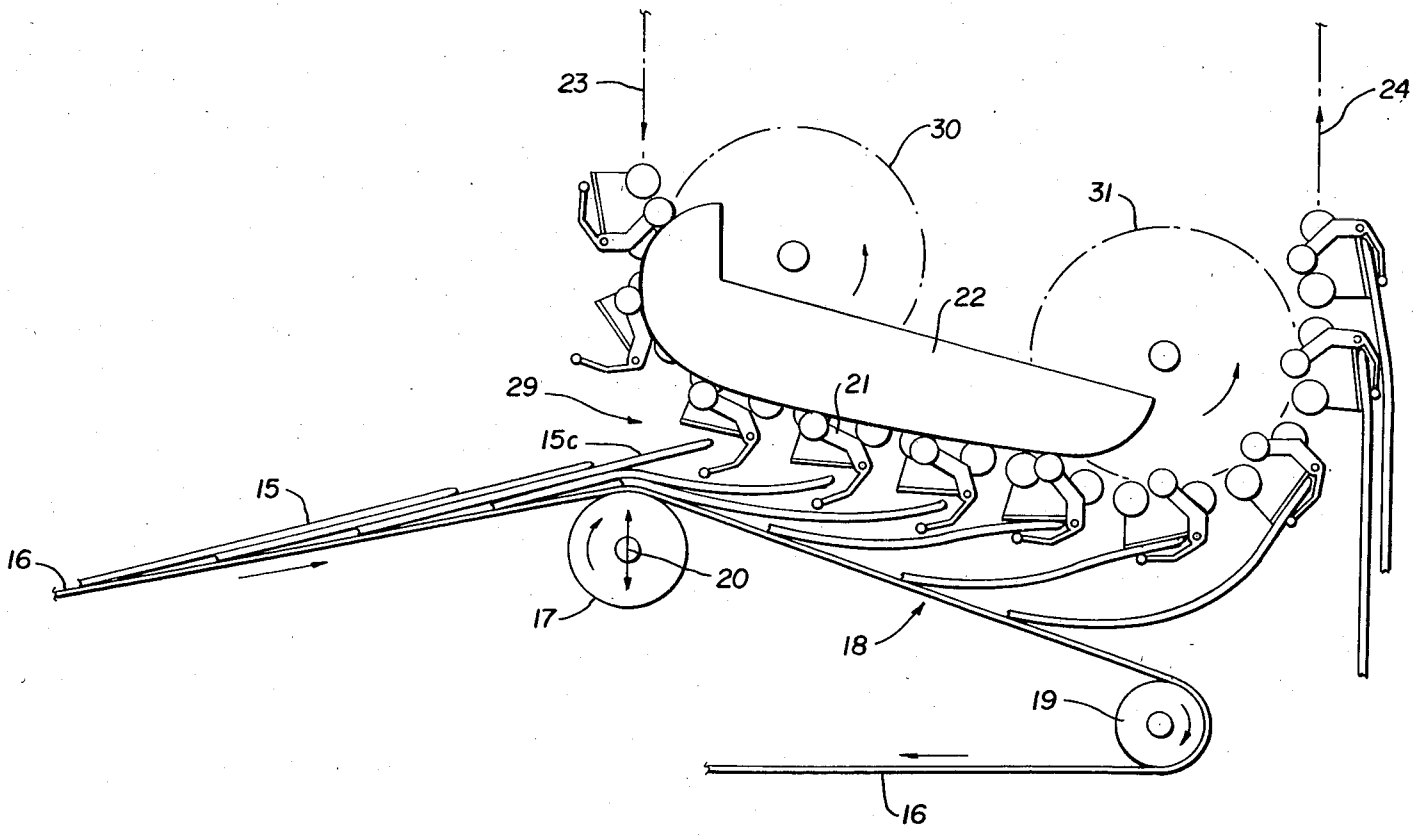
24
31
30
22
21
23
29
15c
20
17
18
19
16
15
16

TRANSFERRING NEWSPAPERS OR THE LIKE FROM A MOVING BELT TO A SERIES OF CLAMPS

TECHNICAL FIELD

This invention relates to the conveyance of printed articles, such as folded newspaper sheets of various weights and sizes from day to day at carefully controlled spacing, and more particularly it relates to the transfer of a sequence of papers carried flat on generally horizontally disposed movable belt conveyors into a series of accurately spaced clamps or tractors movable along a different conveyance path, one product per one clamp or tractor.

BACKGROUND ART

This is an improvement over my U.S. Pat. No. 4,424,965 for "High Speed Transport System for Newspapers and the Like", issued Jan. 10, 1984. Therein, a newspaper carrying clamp assembly is disclosed having registration stops in the clamps for receiving and precisely aligning newspapers with exact interpaper spacings. Also mechanisms therein are provided for transfer of the newspapers between belt conveyors and clamps.

Also, other belt to clamp transfer systems are know, typically as disclosed in U.S. Pat. No. 4,333,559 to Walter Reist issued June 8, 1982.

However, these prior art systems have difficulty in processing newspapers reliably because of large variations in the number of sheets and weight occurring day to day. In particular, a Sunday newspaper edition may have a large number of pages and high weight as compared with a Tuesday edition. This is a particular problem whenever accelerators such as nip rollers are employed unless adjustments are provided for proper handling of varying thickness or weight.

Also, a satisfactory transfer problem is posed in fully registering a newspaper travelling along a conveyor belt against stops in a moving clamp. Thus, the papers if travelling too fast bounce away from the stops by hitting them too hard. Also papers with trailing edges resting on a conveyor belt may be dragged out of the clamps before they become fully closed by the weight of the paper dragging on the belt.

Thus, it is the object of this invention to provide a more reliable and less critical conveyance system operable to transfer printed articles such as newspapers which vary in weight and thickness from a moving belt into the jaws of a sequence of individual clamps moving in a path intercepting the leading edge of the newspapers.

Other objects, features and advantages of the invention will be found throughout the following description, the drawing and the claims.

DISCLOSURE OF THE INVENTION

Newspapers are passed fold forward on a generally horizontally disposed endless conveyor belt which at the paper delivery end passes over a peak roller and declines downwardly for a predetermined distance at an angle to horizontal terminating at a return roller. A second receiving conveyor comprises a series of movable tractors with programmable paper receiving clamps, moving in a path at a lower speed than the first conveyor belt. The clamps are passed generally vertically downwardly and around a roller of known diameter to present the opened clamps in position in a path parallel to the conveyor belt over said predetermined distance transferred thereinto from the faster moving belt. The two conveyor paths are disposed parallel for a long enough path that the papers will enter a plurality of the clamps gradually as they are urged thereinto by the higher speed belt. Thus, the papers are positively and reliably fed and clamped along a non-critical difference that is operable over significant changes of weight or thickness, without any kind of special handling or sorting mechanisms including nip rollers.

BRIEF DESCRIPTION OF THE DRAWING

In the single FIGURE of the drawing the schematic end view of a segment of a high speed transport system for paper illustrates movement of papers moving on a conveyor belt into a transfer junction position with the path of a series of interconnected clamps which receive individual papers for continued conveyance in accordance with this invention.

THE PREFERRED EMBODIMENT

My hereinbeforementioned U.S. Pat. No. 4,424,965 provides a high speed transport system for newspapers in which individual newspapers are transported by a train of movable tractors each with programmable clamps receiving and holding newspapers for conveyance over various transport paths. Means provided in this transport system transfers individual papers from a series of shingled newspapers carried on a moving conveyor belt into moving clamps at high speeds. The transfer requires a speed up of the newspapers by means of nip rollers at the entry position to enter the opened clamps and registering therein against a clamp stop with the papers moving at a higher speed than the moving clamp speed. The transfer from the belt to the clamp takes place over a small distance around the circumference of a wheel about which the tractors move and the clamps are programmed to open for receiving individual papers and to close for clamping individual papers in each clamp for transport along a desired path.

It has been found that this transfer procedure from the belt to the clamps is critical in nature to the weight and thickness of the newspapers, which are accelerated by the nip rollers into the open clamps. Thus, adjustment is necessary when significant changes of conveyance speed or weight and thickness of the papers occur.

In this invention therefore, the nip rollers are eliminated so that the adjustments for paper speed, weight and thickness are less critical and the transfer of the papers off the conveyor belt into the opened clamps is lengthened to avoid critically short timing in the entry and registration of the paper in the clamp. Accordingly, the paper transportation system of this invention needs little adjustment over wide ranges of speed and paper weight and can be run at higher speeds because of the less critical timing necessary in the transfer process.

Reference is thus made to the transfer mechanism embodiment shown in the single drawing FIGURE. It is seen that the endless conveyor belt 16 upon which shingled papers 15 are carried into the transfer zone passes over rollers 17 and 19 which provide a transfer section 18 of the belt of predetermined length encompassing several clamp positions 21, which declines downwardly from the generally horizontal conveyance path of newspapers 15 into the transfer zone on belt 16.

The tractor conveyance chain or cable 23 moves vertically downwardly and around roller 30 to pass the clamps 21 in a path parallel to the transfer section 18 of the conveyor belt 16 before passing around roller 31 into a desired conveyance path. It may be seen that the cam 22 engages the pivotable clamp arms on the tractor to open the clamps along the initial portion of the transfer section 18 path and to close the clamps near the end of that path, thus permitting the papers 15 as shown to gradually enter the clamps and abut the stops before being clamped tightly in place.

For operation therefore in the transfer process, the belt 16 travels at a higher speed than cable or chain drive 23 in order to push the papers 15 into the clamps. Since paper speeds from various presses or systems are variable, the speed of belt 16 may be described as a typical speed permitting 4 four inches (10 cm) between the shingled leading edges of papers 15 on the belt 16. The system may be electronically or mechanically driven by matched relative speeds. The tractor drive cable 23 typically carries the clamps 21 at three inch (7.5 cm) spacings for thus permitting the papers to overtake and enter the open clamps along the transfer section 18.

Because of the downward incline of belt 16 over the transfer section 18, there will be a greater tendency for the papers 15 to be urged into clamps 21 and less tendency to encounter any friction during the process of removing a shingled paper from the belt which might tend to withdraw the paper from registration against the clamp stop. Because of the parallel clamp path and shingled paper movement path over the transfer zone, the papers are more gradually inserted into the clamps in the direction of chute 29 without accelerating means for a reliable transfer operational at higher speeds than heretofore attainable. The transfer operation is thus not critical. However, for significant changes in paper thickness, the roller 17 may be vertically adjustable, as indicated by arrow 20, in order to feed properly into the open clamp 21.

Having therefore described the improved apparatus and operation of this invention and having advanced the state of the art, those novel features believed descriptive of the spirit and nature of the invention are defined with particularity in the claims.

I claim:

1. In a conveyance system for transporting newspapers or the like by a succession of individual clamps, improved means for transferring the newspapers from a shingled array on a conveyor belt into the clamps for further transport thereby, comprising in combination, conveyor belt means for transporting a shingled array of said newspapers along a conveyor belt path into a transfer station at a speed presenting the leading edges of the newspapers spaced by a distance X for a given increment of time, clamp conveyance means for transporting a succession of spaced clamps in a path approaching the conveyor belt means and passing substantially parallel with a conveyor belt path section of the transfer station in the same direction before diverging therefrom at the end of a transfer zone encompassing a plurality of clamps, wherein the clamps are transported at a speed spacing the clamps a distance less than X for said increment of time, thereby permitting individual newspapers on the belt to move towards and overtake individual clamps within said transfer zone, cam means synchronously operable to open the clamp jaws and to close them gradually over said transfer zone to receive thereinto said newspaper leading edges and clamp them in place for transport by the clamp conveyor means as they are conveyed in part on said belt through the transfer zone and means operable after the newspapers pass the conveyor belt path transfer zone diverging the paths of the conveyor belt path and the clamp conveyance means to remove the newspapers from the belt in the grasp of the individual clamps, and insertion means comprising conveying solely by frictional contact of a shingled array of newspapers on the conveyor belt over a roller where the direction of the belt path is changed to a downwardly inclined direction for registering the leading edge of newspapers carried on the belt into the open clamps in the initial part of the transfer zone.

2. In a conveyance system as defined in claim 1, wherein the conveyor belt means is a single conveyance belt passing over the roller at the transfer station to change direction of the conveyor belt path transporting the shingled array into the transfer station to a downwardly inclined path along the transfer zone where papers are grasped by the clamps.

3. Apparatus as defined in claim 2 including means operable with said insertion means for adjusting the conveyor belt path vertically at a position adjacent the entry of an individual newspaper leading edge into an individual clamp in order to register newspapers of different thicknesses into the clamps after passing over said roller at the transfer zone.

4. The conveyance system defined by claim 1 further characterized by cam means engaging the spaced clamps to open clamp jaws for receiving the newspapers thereinto at the transfer station and to close the jaws gradually over the transfer zone along the downwardly inclined path of the belt.

5. The conveyance system defined in claim 1 wherein the conveyor belt path into the transfer station is substantially horizontal.

6. The conveyance system defined in claim 1 wherein the spaced clamps have pivoted jaws opening and closing by movement about a pivot axis parallel to the newspaper leading edge entering the clamp.

* * * * *